United States Patent [19]

Lawson et al.

[11] 4,115,907

[45] Sep. 26, 1978

[54] FIBER PROCESS

[75] Inventors: Ronald Lawson; David Watson, both of Harrogate, England

[73] Assignee: Imperial Chemical Industries Limited, London, England

[21] Appl. No.: 831,827

[22] Filed: Sep. 9, 1977

[30] Foreign Application Priority Data

Sep. 9, 1976 [GB] United Kingdom ..... 37386/76

[51] Int. Cl.[2] ..... D02G 1/12

[52] U.S. Cl. ..... 28/266; 28/267

[58] Field of Search ..... 28/262, 265, 266, 267, 28/269

[56] References Cited

U.S. PATENT DOCUMENTS

| | | | |
|---|---|---|---|
| 2,575,839 | 11/1951 | Rainard | 28/267 |
| 3,108,352 | 10/1963 | Haigler et al. | 28/266 |
| 3,174,208 | 3/1965 | Saito et al. | 28/266 |
| 3,975,807 | 8/1976 | Bramley et al. | 28/266 |

FOREIGN PATENT DOCUMENTS

| | | | |
|---|---|---|---|
| 999,650 | 7/1965 | United Kingdom | 28/267 |

*Primary Examiner*—Louis K. Rimrodt
*Attorney, Agent, or Firm*—Robert J. Blanke

[57] ABSTRACT

A process and apparatus for the continuous production of heat-set, crimped, thermoplastic filaments by passing a tow of filaments through a stuffer box crimper and then a heat setting device attached to the exit of the crimper. The tow in the crimping chamber is cooled to a temperature not exceeding 100° C in order to separate the heat setting and crimping processes, whereby the crimp ratio may be varied by adjusting the temperature of the tow in the crimping chamber.

3 Claims, 1 Drawing Figure

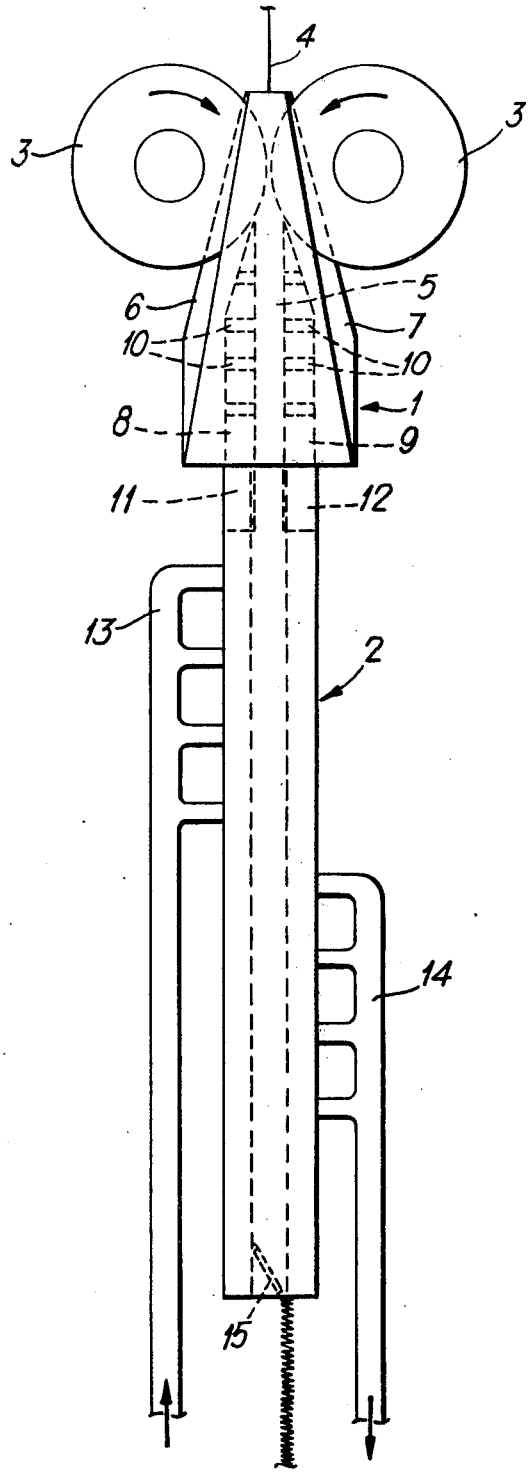
4
3
3
5
6
7
10
10
1
8
9
11
12
13
2
14
15

FIBER PROCESS

The present invention relates to a process and an apparatus for the production of heat set crimped yarn.

It is known to crimp filaments made from thermoplastic polymers by feeding the filaments in the form of a tow into a chamber, the dimensions of which cause the filaments to crimp within the chamber. This type of crimping is known as stuffer box crimping. The crimp developed by this method is not particularly stable, especially when the crimped fibers are subjected to further processing and/or when the fibers, in fabric form, are subjected to everyday use and washing. The crimp may be stabilised by subjecting the crimped fibers to a high temperature treatment to 'set in' the crimp. It has been customary to carry out the high temperature heating process by autoclaving batches of the crimped tows. Autoclaving is a slow and costly process, and more recently continuous crimping and heat setting processes have been devised to improve productivity. One such process involves the attachment of a fluid heat setting tube to the exit of a stuffer box crimper, and British Pat. No. 1,364,062 describes a fluid heat setting tube particularly suitable for this purpose.

Unfortunately the continuous crimping and heat setting process, whilst increasing efficiency and reducing costs, produces a product which has a different crimp geometry from that of fibers produced by the two stage process. Crimp geometry is a combination of crimp frequency and crimp ratio. Crimp frequency is defined as the number of crimps per unit length whilst crimp ratio is the ratio of the difference in length between the fully extended fiber and the crimped fiber to the length of the fully extended fiber. Normally the crimp ratio is expressed as a percentage. Test methods for determining these values are well known.

It is essential that fiber to be subjected to a carding process and subsequent treatment has the correct crimp geometry for the particular processing conditions employed otherwise difficulties will be experienced. Many commerical processes have been developed for use of crimped fiber produced by the two stage process involving batch heat setting. Unfortunately fiber produced by the continuous crimping heat setting process, because of its different crimp geometry, gives rise to considerable difficulties during carding when subjected to the commerical processes.

It has now been found that in a continuous crimping-heat setting process, cooling the filaments in the stuffer box before passing them into the heat setting zone of the apparatus modifies the crimp geometry of the crimped filaments, the actual degree of modification depending upon the extent of cooling. In this way, heat-set, crimped filaments having a range of crimp geometry characteristics, including those of the conventional two stage batch process, may be produced by a continuous process.

According to the present invention, a process for the continuous production of heat-set, crimped, thermoplastic filaments comprises continuously feeding, by means of conveyor surfaces, a tow of filaments into the crimping chamber of a stuffer box crimper to crimp the tow, and passing the crimped tow through a heat setting device attached to the exit of the stuffer box crimper, wherein the tow in the crimping chamber is cooled to a temperature not exceeding 100° C. preferably that section of the tow heat setting device directly attached to the exit of the crimping chamber has gas injection orifices to further cool the tow.

According to a further aspect of the present invention, apparatus for the continuous production of heat-set, crimped, thermoplastic filaments comprises a stuffer box crimper having conveyor surfaces for continuously feeding a tow of filaments into the crimping chamber thereof, a means for cooling the tow in the crimping chamber to a temperature not exceeding 100° C., and a tow heat setting device attached to the exit of the stuffer box crimper.

The conveyor surfaces for continuously feeding the tow into the crimping chamber of the stuffer box crimper may be in the form of two or more co-operating belts. Preferably the surfaces are formed by a pair of rotating nip rolls, and when the tow comprises filaments of low denier, it is desirable that the surfaces of the nip rolls are cooled, for example by passing cold water through the rolls.

The tow is cooled in the crimping chamber, whereby at least part of the heat produced by the mechanical crimping of the filaments is dissipated, and the filaments do not reach a temperature exceeding 100° C. Cooling may be achieved by circulating cooling fluid through the walls of the crimping chamber. Preferably the tow is cooled by gas, particularly air, being injected into the crimping chamber through one or a series of orifices. Conveniently the orifice or series of orifices is formed in the side plates and/or doctor blades of a conventional stuffer box crimper. When a series of orifices is used, some of the orifices may be formed in the section of the heat setting device directly attached to the exit of the stuffer box crimper to extend the length of the cooling zone and to prevent heat from the heat-setting device reaching the tow in the crimping chamber. The fluid heat setting apparatus described in British patent specification No. 1,364,062 is readily modifiable to incorporate air injection orifices in the first section.

Thermoplastic filaments suitable for crimping by the process of the present invention, or in the apparatus of the present invention, include filaments of polyamides or copolyamides, such as, for example, nylon-6, nylon-66, and copolymers thereof, and filaments of polyesters or copolyesters, such as, for example, poly(ethylene terephthalate) and copolymers thereof.

By adjusting the dimensions of the crimping chamber of the stuffer box chamber, for example, by adjusting the pressure applied to the doctor blades, and also the temperature of the tow in the crimping chamber, for example, by adjusting the flow of cooling gas through the orifices of the doctor blades, crimped filaments having different crimp geometry may be produced. The process of the present invention is particularly suitable for continuously producing heat-set, crimped fibers having a range of crimp ratio and crimp frequency values which have not been hitherto obtainable by a continuous stuffer box-crimping-heat setting process. Thus, the crimp frequency of the fiber may be varied by adjustment of the pressure applied to the doctor blades of the stuffer-box crimper, whilst the crimp ratio may be varied by adjustment of the temperature of the fiber in the crimping chamber of the stuffer-box crimper.

One embodiment of the invention will now be described by way of example with reference to the accompanying drawing, which shows a side elevation of an apparatus according to the invention.

The apparatus, for the continuous production of heat-set, crimped, thermoplastic filaments, comprises a stuffer box crimper 1 having a tow heat setting device 2 attached to the exit and thereof. The stuffer box crimper has conveyor surfaces in the form of a pair of rotatable nip rolls 3 for continuously feeding a tow 4 into the crimping chamber 5. The crimping chamber is formed by a front wall 6, a back wall 7, and doctor blades 8 and 9. The doctor blades are urged towards each other by the application of pressure, by a means not shown, to adjust the dimensions of the crimping chamber. The doctor blades have a series of orifices 10 in communication with a supply (not shown) of cool, compressed air. Each doctor blade has an extension 11, 12 at the lower end which fits into the mouth of the heat setting device 2.

The heat setting device 2 is in the form of a sectioned tube. Saturated steam is fed into the first section of the tube from a manifold 13, and in the following section the pressure of the steam from the preceding section is relieved to atmospheric pressure through an exhaust manifold 14. The discharge end of the heat setting tube is restricted by means of a hinged flap 15.

In use, the tow 4 is continuously fed by means of the nip rolls 3 into the crimping chamber 5, the dimensions of which are adjusted by varying the pressure exerted on them by means not shown, to give the desired yarn crimp frequency. Cool, compressed air is fed into the chamber through the orifices 10 in the doctor blades 8 and 9 to maintain the tow in the chamber at a temperature not exceeding 100° C. to give the required crimp ratio.

The continuous feeding of the tow into the crimping chamber of the stuffer box crimper causes the crimped tow already in the crimping chamber to be transferred to the heat setting tube 2. The tow passing through the first section of the tube is heated by the saturated steam supplied from the manifold 13, to a temperature at which the crimp is set in the tow. The tow then passes into the next section of the tube in which the steam from the preceding section is relieved to atmospheric pressure by escaping into the manifold 14. Finally, the tow emerges from the tube via the hinged flap 15.

In a modification of the apparatus shown in the drawing, the heat setting tube 2 is modified so that the part of the first section directly attached to the stuffer box crimper is supplied with cool compressed air rather than steam. This modification extends the length of the zone in which the tow is cooled to a temperature not exceeding 100° C., and helps to isolate still further the crimping and heat setting zones.

The range of crimp geometry now obtainable for continuously crimped and heat set yarns is illustrated in the following examples. In examples 1 to 6 and Comparative Example A a 53 k'tex nylon-66 tow of filaments each of 6.7 dtex was continuously crimped and heat set in an apparatus substantially as described above, the crimper part of the apparatus being a Turbo crimper and the heat setting tube essentially the same as that described in British Pat. No. 1,364,062. In examples 1–4, air was supplied solely to the doctor blades of the crimper, whilst in examples 5 and 6 air was also supplied to part of the first section of the heat setting tube directly attached to the crimper. The results of the examples, given in the table below, clearly show how the crimp frequency of the resulting yarn is primarily controlled by the stuffer box pressure, ie the pressure applied to the doctor blades, whilst the crimp ratio is primarily controlled by the flow rate of air to the crimping chamber and the extent of the zone cooled by the air. The conditions used for the examples and the properties of the resulting tow are given in Table I.

TABLE 1

| EXAMPLE NO | CRIMP ROLL PRESSURE (psi) | STUFFER BOX PRESSURE (psi) | AIR TO CRIMPER (lpm) | AIR TO HEAT SETTING TUBE (psi) | STEAM TO HEAT SETTING TUBE (psi) | TOW PROPERTIES CRIMP RATIO % | TOW PROPERTIES CRIMP FREQUENCY (CPI) | TOW PROPERTIES EXTENSION % |
|---|---|---|---|---|---|---|---|---|
| Comparative A | 12 | 10 | 0 | 0 | 12± 1 | 19.5 | 12.2 | — |
| 1 | 15 | 18 | 140 | 0 | 15± 1 | 14.7 | 10.8 | 45.0 |
| 2 | 14 | 18 | 200 | 0 | 15± 1 | 10.1 | 10.2 | 58.5 |
| 3 | 14 | 20 | 260 | 0 | 19± 2 | 9.8 | 10.2 | 55.8 |
| 4 | 18 | 40 | 260 | 0 | 19± 2 | 14.0 | 13.7 | 57.2 |
| 5 | 18 | 40 | 200 | 30 | 15± 1 | 11.5 | 12.4 | 50.6 |
| 6 | 18 | 30 | 260 | 30 | 18± 2 | 7.8 | 12.0 | 55.3 |

The following examples, in which the stuffer box crimper-heat setting tube was the same as that used in the preceding examples, illustrates the application of the process to nylon-66 filaments of different dtex. The conditions used and the properties of the resultant tow are given in Table II.

The stable fiber of Comparative Example B was found to be difficult to card continuously and gave a high nep content, whereas the fiber from Example 7 could be continuously carded without any difficulties. Similar difficulties were experienced during the carding of fiber from Comparative Examples C, D and E, whereas fiber from Examples 8, 9 and 10 could be processed without difficulty.

TABLE 2

| EXAMPLE NO | FILAMENT DTEX | CRIMP ROLL PRESSURE (psi) | STUFFER BOX PRESSURE (psi) | AIR TO CRIMPER (lpm) | AIR TO HEAT SETTING TUBE (psi) | STEAM TO HEAT SETTING 1% (psi) | TOW PROPERTIES CRIMP RATIO (%) | TOW PROPERTIES CRIMP FREQUENCY (CPI) | LENGTH TO WHICH FILAMENTS ARE CUT MM |
|---|---|---|---|---|---|---|---|---|---|
| Comparative B | 3.3 | 15 | 18 | 0 | 0 | 12±2 | 28±2 | 18±2 | 58 |
| 7 | 3.3 | 18 | 20 | 310 | | 12±2 | 20±2 | 19±2 | 58 |
| Comparative C | 6.7 | 15 | 15 | 0 | 0 | 12±2 | 18±2 | 12±2 | 50 |
| 8 | 6.7 | 18 | 20 | 260 | | 12±2 | 13±2 | 12±2 | 50 |

TABLE 2-continued

| EX-AMPLE NO | FILA-MENT DTEX | CRIMP ROLL PRESSURE (psi) | STUFFER BOX PRESSURE (psi) | AIR TO CRIMPER (1pm) | AIR TO HEAT SETTING TUBE (psi) | STEAM TO HEAT SETTING 1% (psi) | TOW PROPERTIES CRIMP RATIO (%) | TOW PROPERTIES CRIMP FRE-QUENCY (CPI) | LENGTH TO WHICH FILA-MENTS ARE CUT MM |
|---|---|---|---|---|---|---|---|---|---|
| Comparative D | 17 | 15 | 30 | 0 | 0 | 12±2 | 26±2 | 12±2 | 100-140 |
| 9 | 17 | 18 | 32-34 | 340 | | 12±2 | 19±2 | 12±2 | 100-140 |
| Comparative E | 6.7 | 15 | 20 | 0 | 0 | 12±2 | 38±4 | 20±3 | 100-150 |
| 10 | 6.7 | 18 | 25-28 | 410 | | 12±2 | 23±3 | 19±3 | 100-150 |

We claim:

1. In a process for the continuous production of heat-set, crimped, thermoplastic filaments selected from the group consisting of polyamide filaments or copolyamide filaments and polyester filaments or copolyester filaments, comprising feeding by means of conveyor surfaces, a tow of filaments into the crimping chamber of a stuffer box crimper to crimp the tow, and passing the crimped tow through a heat setting device attached to the exit of the stuffer box crimper, the improvement comprising cooling the tow while in the crimping chamber to a temperature not exceeding 100° C.

2. A process according to claim 1 wherein the tow in the crimping chamber is cooled by injecting a gas into the crimping chamber.

3. A process according to claim 2 wherein the crimped tow is further cooled by injecting a gas into the section of the heat setting device directly attached to the stuffer box crimper.

* * * * *